US005443403A

United States Patent [19]

Weidler et al.

[11] Patent Number: 5,443,403

[45] Date of Patent: Aug. 22, 1995

[54] COMPOSITE ELECTRICAL CONNECTOR ASSEMBLY WITH SNAP-IN HOUSING

[75] Inventors: Charles H. Weidler, Lancaster; George H. Douty, Mifflintown, both of Pa.

[73] Assignee: The Whitaker Corporation, Wilmington, Del.

[21] Appl. No.: 148,763

[22] Filed: Nov. 3, 1993

Related U.S. Application Data

[63] Continuation-in-part of Ser. No. 29,085, Mar. 9, 1993, Pat. No. 5,314,357.

[51] Int. Cl.[6] ..... H01R 13/514

[52] U.S. Cl. ..... 439/701; 439/557

[58] Field of Search ..... 439/701, 739, 680, 638, 439/532, 540, 247, 248, 552, 553, 555, 557

[56] References Cited

U.S. PATENT DOCUMENTS

| | | | |
|---|---|---|---|
| 2,891,103 | 6/1959 | Swengel | 174/153 |
| 3,547,274 | 12/1970 | Sosinkski | 439/532 |
| 4,046,449 | 9/1977 | Ranzanigo | 439/553 |
| 4,596,436 | 6/1986 | Kraemer et al. | 339/206 R |
| 4,659,162 | 4/1987 | Cartesse | 439/557 |
| 4,883,432 | 11/1989 | Reed | 439/553 |
| 4,915,641 | 4/1990 | Miskin et al. | 439/247 |
| 4,923,408 | 5/1990 | Zinn | 439/341 |
| 4,997,386 | 3/1991 | Kawachi et al. | 439/352 |
| 5,125,854 | 6/1992 | Bassler et al. | 439/607 |
| 5,145,411 | 9/1992 | Pastal et al. | 439/598 |
| 5,184,961 | 2/1993 | Ramirez et al. | 439/540 |
| 5,190,476 | 3/1993 | Chaillot | 439/595 |

*Primary Examiner*—Larry I. Schwartz
*Assistant Examiner*—Hien D. Vu

[57] ABSTRACT

A composite electrical connector assembly (20) includes a plurality of individual cable connectors (24, 26, 28) contained within a unitary housing (22) having an interior cavity (76). The connectors have front mating portions ( 30, 32, 34 ) which extend through open regions (70, 72, 74) on the front wall (60) of the housing and are retained by resilient latch members (78, 86, 92, 94) within the housing cavity and which engage the back surfaces (48, 50, 52) of enlarged portions (42, 44, 46) of the connector bodies (36, 38, 40).

16 Claims, 6 Drawing Sheets

COMPOSITE ELECTRICAL CONNECTOR ASSEMBLY WITH SNAP-IN HOUSING

BACKGROUND OF THE INVENTION

This is a continuation-in-part of U.S. application Ser. No. 08/029,085, filed Mar. 9, 1993, now U.S. Pat. No. 5,314,357.

This invention relates to an electrical connector assembly for cables and, more particularly, to a composite electrical connector assembly formed by inserting a plurality of individual electrical cable connectors into a unitary housing.

An electrical cable connector typically comprises a contact-receiving insulative body wherein the contacts are arranged in at least one row and are connected to individual insulated conductors. Such connectors are available in various sizes and shapes which conform with technical standards governing dimensional configurations and electrical characteristics. Existing connectors often are inadequate to meet renewed demands for faster and more compact electronic devices. To specify new technical standards for connectors requires the design of totally new connectors. As an alternative to the design of a new connector, it is an object of the present invention to provide a composite electrical connector assembly formed from a number of known connectors which are individually unchanged when forming a part of the composite electrical connector assembly.

It is another object of the present invention to provide a unitary housing into which a plurality of known connectors can be inserted in a simple way without requiring the use of any special tools so as to form the composite electrical connector assembly.

SUMMARY OF THE INVENTION

The foregoing and additional objects of the present invention are attained by providing a composite electrical connector assembly made up of a plurality of cable connectors. Each of the cable connectors has a contact-receiving body, with each of the bodies having a front mating portion, an enlarged portion rearwardly of the front mating portion and a back surface on the enlarged portion facing away from the front mating portion. A unitary housing for the plurality of cable connectors is provided to form the composite assembly. The housing includes a front wall and upper, lower and lateral side walls extending rearwardly from the front wall to define a cavity. The front wall has open regions each corresponding to a respective cable connector body. Each open region is sized to allow the front mating portion of the respective one of the bodies to extend therethrough and is configured to prevent the enlarged portion of that body from passing therethrough. The housing cavity is configured to contain therein, in laterally spaced relation, the enlarged portions of the cable connector bodies, with the front mating portions of the bodies extending through the respective open regions and outwardly beyond the housing front wall. Latch means within the housing cavity engages the back surface of each of the cable connector body enlarged portions as that body is inserted in the cavity toward the front wall and its front mating portion extends through the respective open region and outwardly beyond the front wall. Accordingly, the enlarged portion of each cable connector body is held within the housing cavity between the front wall and the latch means to thereby form the desired composite electrical connector assembly.

According to an aspect of the present invention, the latch means includes a plurality of resilient latch members, each of which includes a forward facing surface adapted for interfering engagement with a respective cable connector body enlarged portion back surface.

In accordance with another aspect of this invention, each of the resilient latch members has a relaxed position in which it extends in a front to rear direction within the housing cavity and within the insertion path of the respective cable connector body enlarged portion. Each latch member is adapted to be moved from its relaxed position transversely out of the respective insertion path as the respective enlarged portion passes thereby and to subsequently snap back to its relaxed position with its forward facing surface in engagement with the respective enlarged portion back surface.

In accordance with a further aspect of this invention, the housing is made of an insulative plastic and is formed by a straight pull molding process.

In summary, the present invention contemplates providing a unitary housing of simple and inexpensive construction which allows a plurality of individual cable connectors to be inserted therein in a snap-fit manner to form a composite electrical connector assembly.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
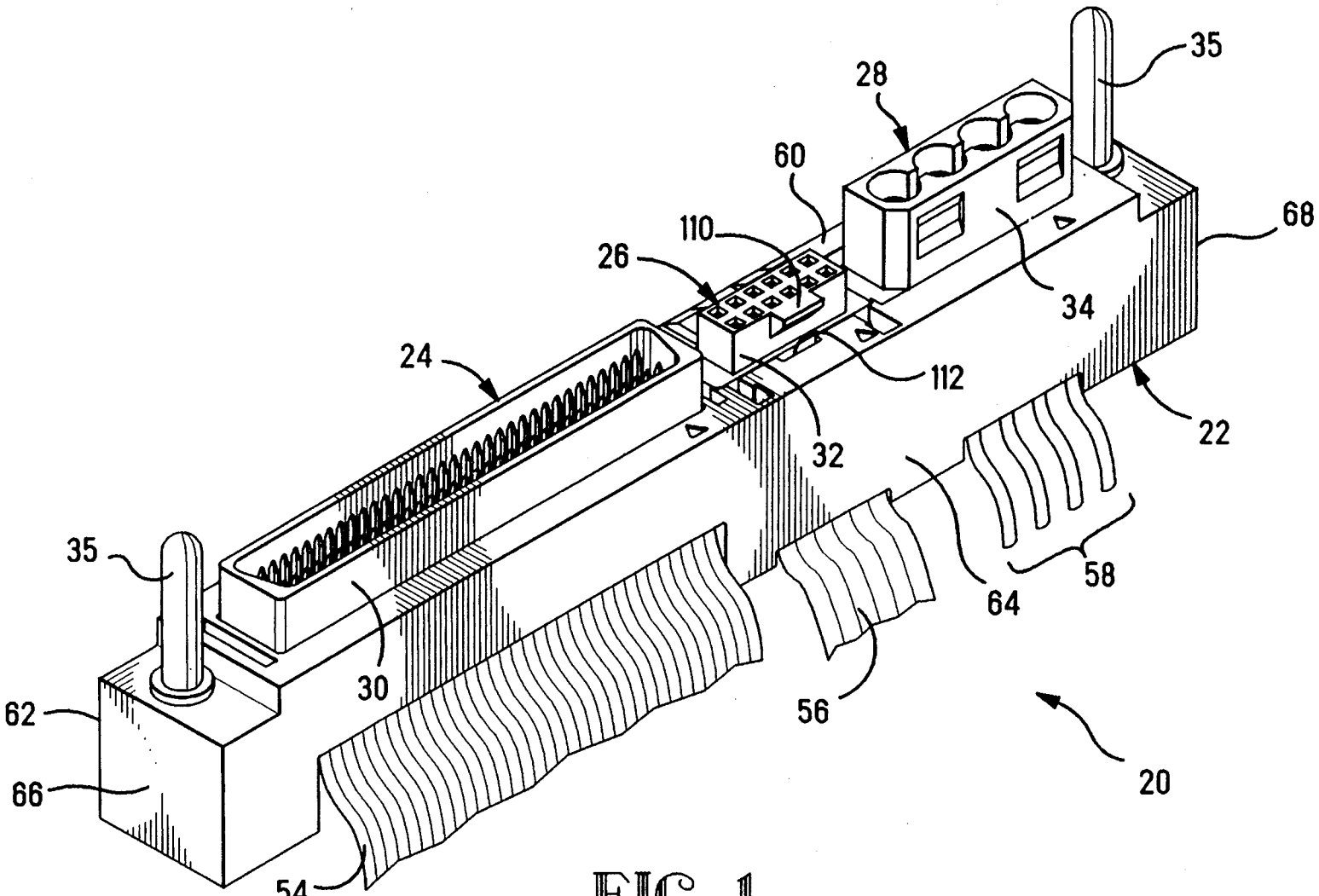
FIG. 1 is a front perspective view showing a composite electrical connector assembly according to the present invention.

Referring now to the drawings, FIG. 1 shows a composite electrical connector assembly, designated generally by the reference numeral 20, according to the present invention. The assembly 20 includes a unitary housing 22 holding three electrical cable connectors 24, 26 and 28. (Although three connectors are illustrated herein, it is understood that for a particular application, the housing 22 can be designed to accommodate fewer or more connectors.) As illustrated, each of the connectors 24, 26, 28 has a respective front mating portion 30, 32, 34 which extends outwardly beyond the front of the housing 22 for mating engagement with a respective complementary connector, as is well known in the art. The guide pins 35 are used as alignment guides for mating connection with another mating electrical connector, as is known in the art.

Figure 2:
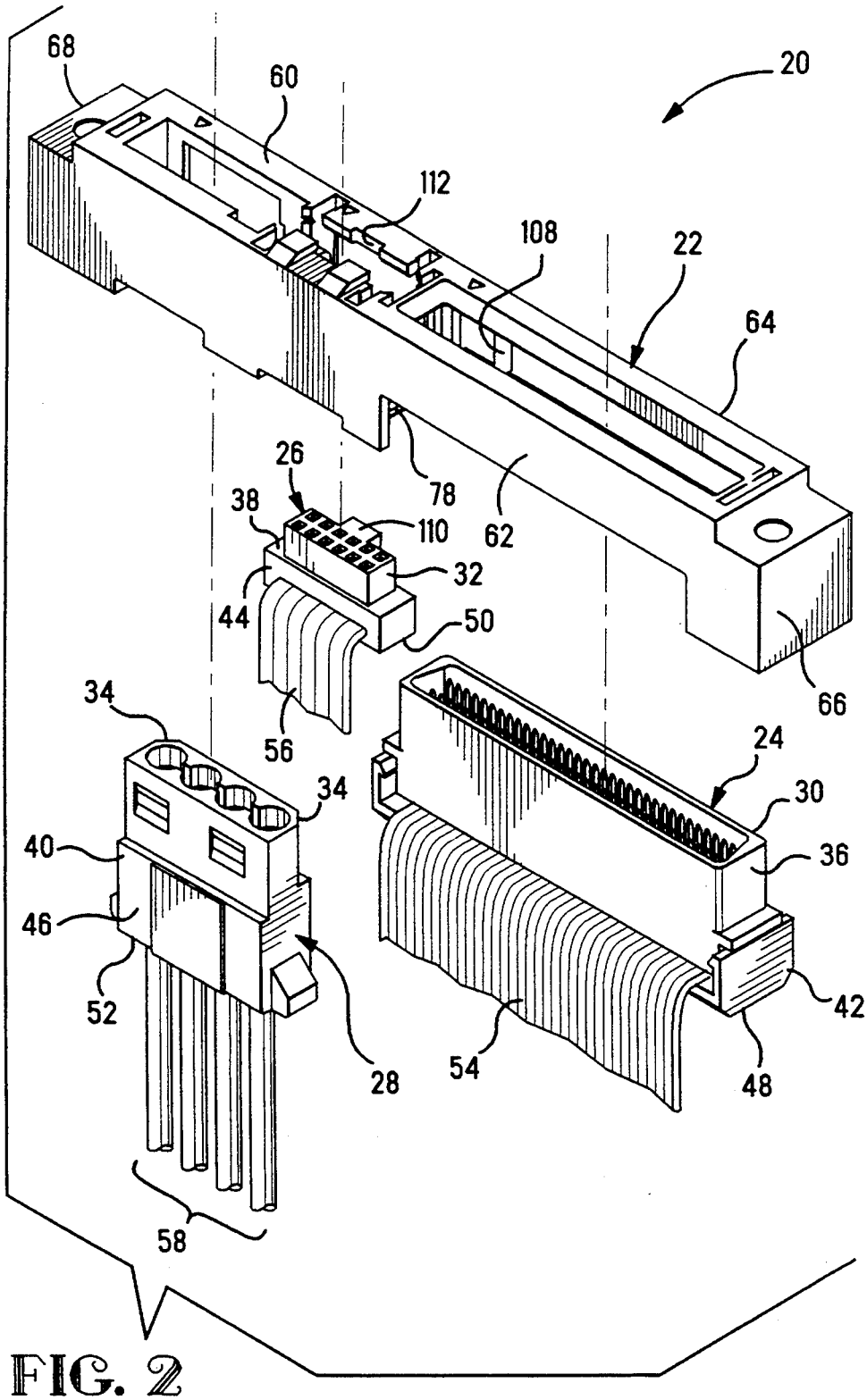
FIG. 2 is an exploded front perspective view of the assembly of FIG. 1.
Figure 3:
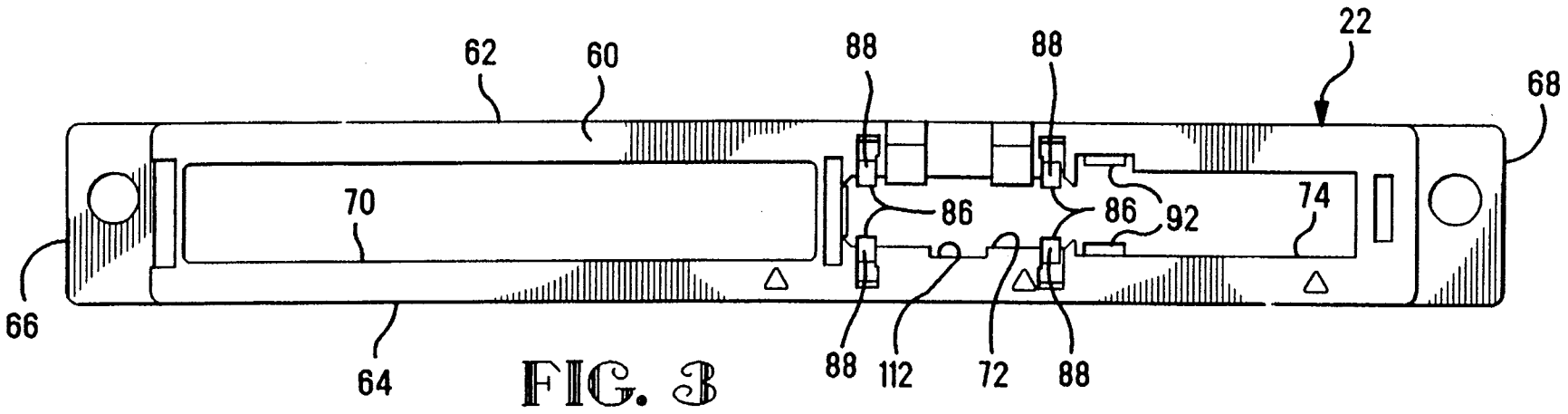
FIG. 3 is a front elevational view of the housing of the assembly of FIG. 1.
Figure 4:
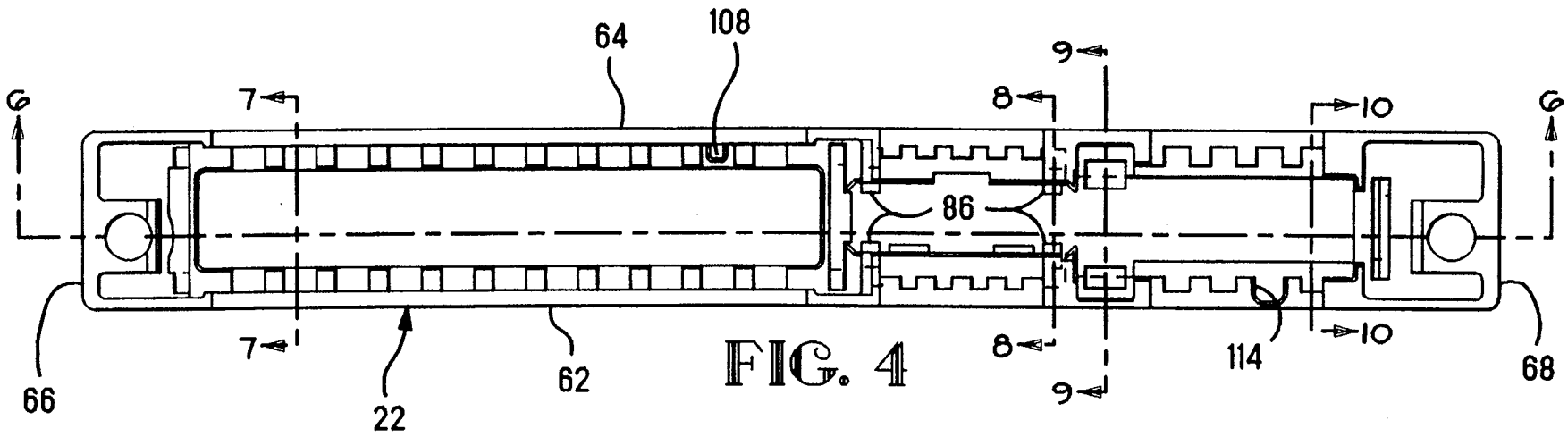
FIG. 4 is a rear elevational view of the housing of the assembly of FIG. 1.
Figure 5:
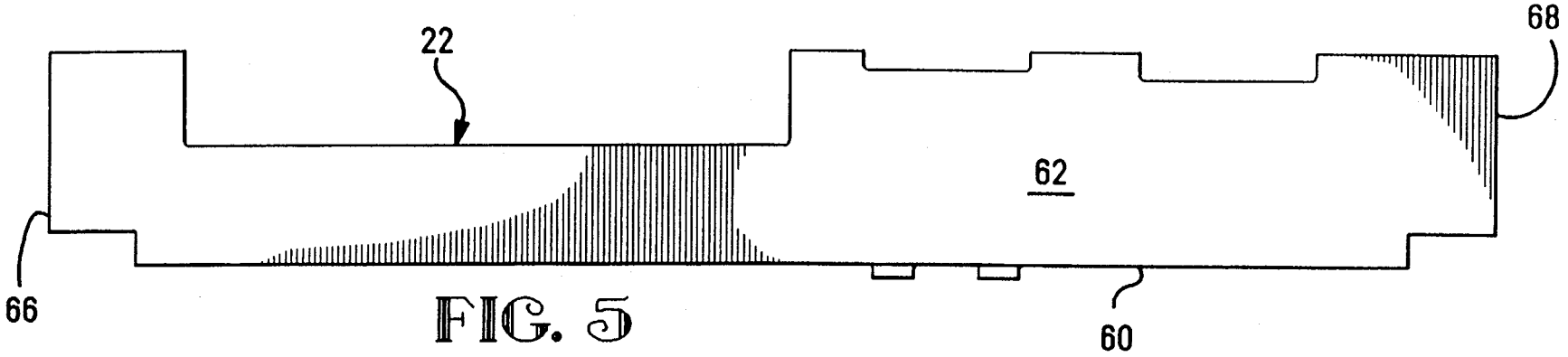
FIG. 5 is a top plan view of the housing of the assembly of FIG. 1.

As shown in FIG. 2, the three connectors 24, 26, 28 are of different construction. Illustratively, the connector 24 is an AMPLIMITE 50 Series connector, the connector 26 is an AMPLATCH 2 mm connector and the connector 28 is a MATE-N-LOK connector, all manufactured by AMP, Incorporated, of Harrisburg, Pa. Each of the connectors 24, 26, 28 has a contact-receiving body 36, 38, 40, respectively, part of which is the front mating portion 30, 32, 34, with a respective enlarged portion 42, 44, 46 rearwardly of the front mating portion and with a respective back surface 48, 50, 52 on each of the enlarged portions. The back surfaces face away from the respective front mating portions. As is conventional, attached to each of the bodies 36, 38, 40 is a respective cable 54, 56, 58 made up of a plurality of individual insulated electrical conductors.

The housing 22 is of molded, unitary construction, illustratively of nylon or a similar insulative plastic, and is so designed that it can be formed by a straight pull molding process. As shown in the drawings, the housing 20 includes a front wall 60, an upper wall 62, a lower wall 64, and lateral side walls 66, 68. The front wall 60 is formed with open regions 70, 72, 74, each corresponding to a respective cable connector 24, 26, 28. Each of the open regions 70, 72, 74 is sized to allow the front mating portion of the respective one of the connector bodies to extend therethrough, and is configured to prevent the enlarged portion of that body from passing therethrough.

The upper wall 62, the lower wall 64, and the lateral side walls 66, 68 extend rearwardly from the front wall 60 of the housing 20 to define an interior cavity 76. The cavity 76 is configured to hold the enlarged portions 42, 44, 46 of the connectors 24, 26, 28 in laterally spaced relation, with the front mating portions 30, 32, 34 extending through a respective open region 70, 72, 74 of the front wall 60.

In order to removably secure the connectors 24, 26, 28 within the cavity 76, the housing 22 is formed with latches extending into the cavity 76. The latches are adapted to engage respective back surfaces 48, 50, 52 of the connectors 24, 26, 28 as each connector is inserted into the cavity 76 and its front mating portion 30, 32, 34 extends outwardly of the respective open regions 70, 72, 74, to hold the enlarged portions 42, 44, 46 within the cavities 76 between the front wall 60 and the latches. As will be described in full detail hereinafter, each of the latches is a resilient member which includes a forward facing surface adapted for interfering engagement with a respective connector back surface. Each latch member has a relaxed position in which it extends in a front to rear direction within the cavity and within the insertion path of the respective cable connector body enlarged portion. Each latch member is moved from its relaxed position transversely out of the respective insertion path as the enlarged portion passes thereby and subsequently snaps back to its relaxed position with its forward facing surface in engagement with the respective back surface, so as to retain the connector in the housing 22.

Figure 6:
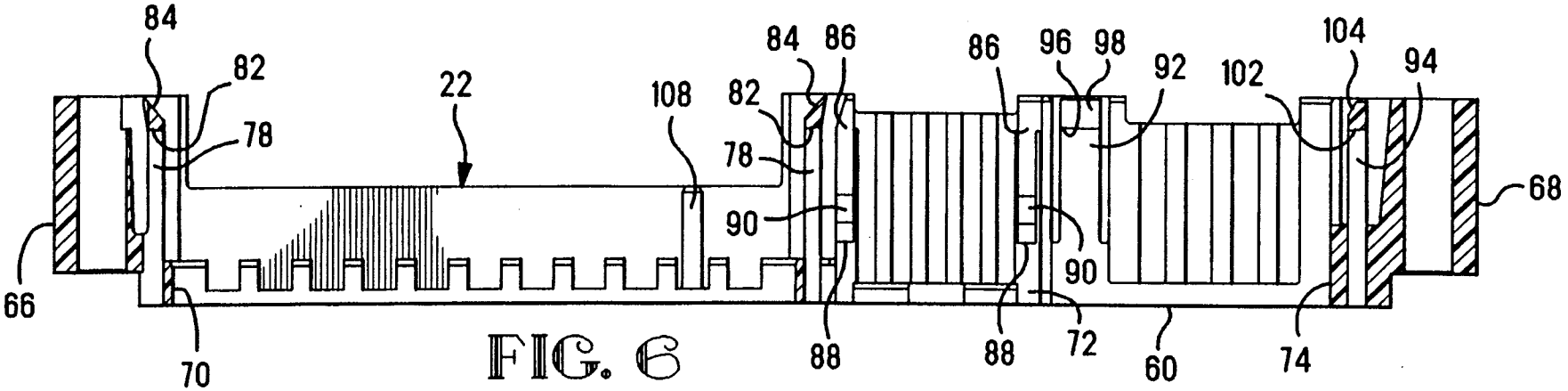
FIG. 6 is a cross sectional view taken along the line 6—6 in FIG. 4.
Figure 7:
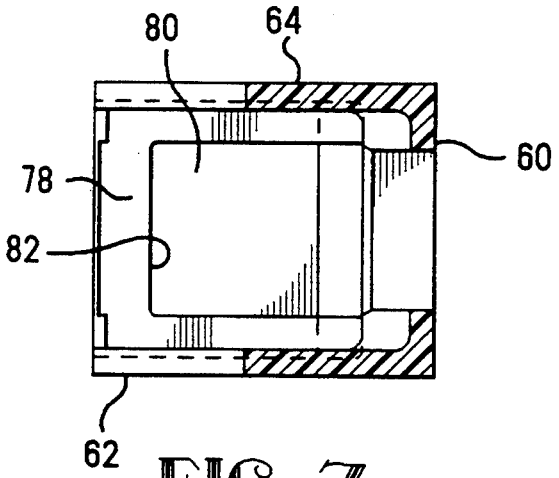
FIG. 7 is a cross sectional view taken along the line 7—7 in FIG. 4.
Figure 8:
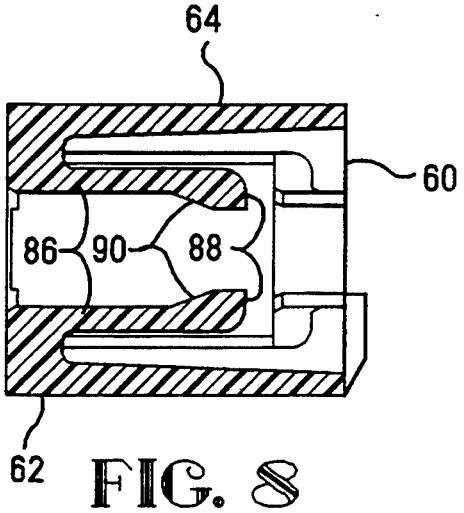
FIG. 8 is a cross sectional view taken along the line 8—8 in FIG. 4.
Figure 9:
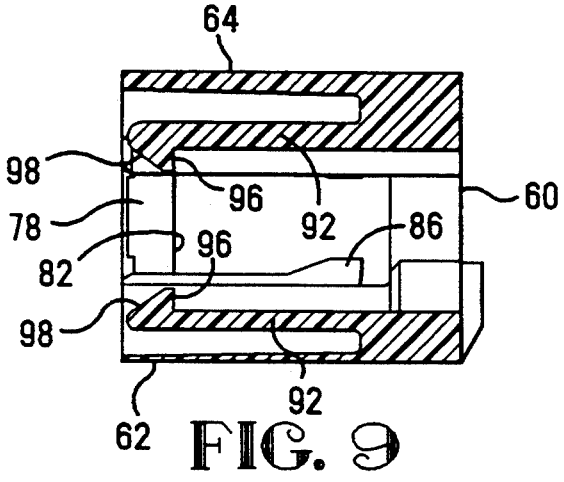
FIG. 9 is a cross sectional view taken along the line 9—9 in FIG. 4.
Figure 10:
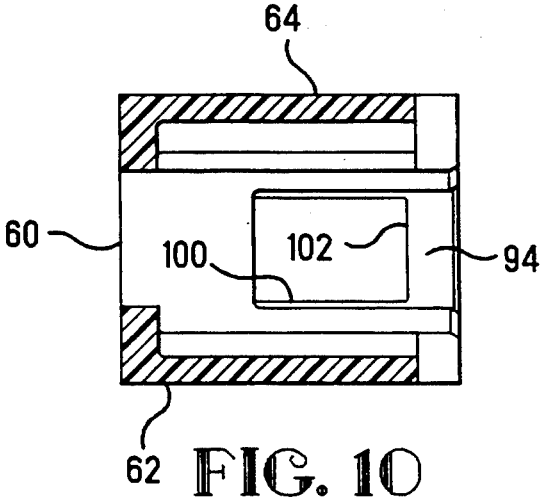
FIG. 10 is a cross sectional view taken along the line 10—10 in FIG. 4.
Figure 11:
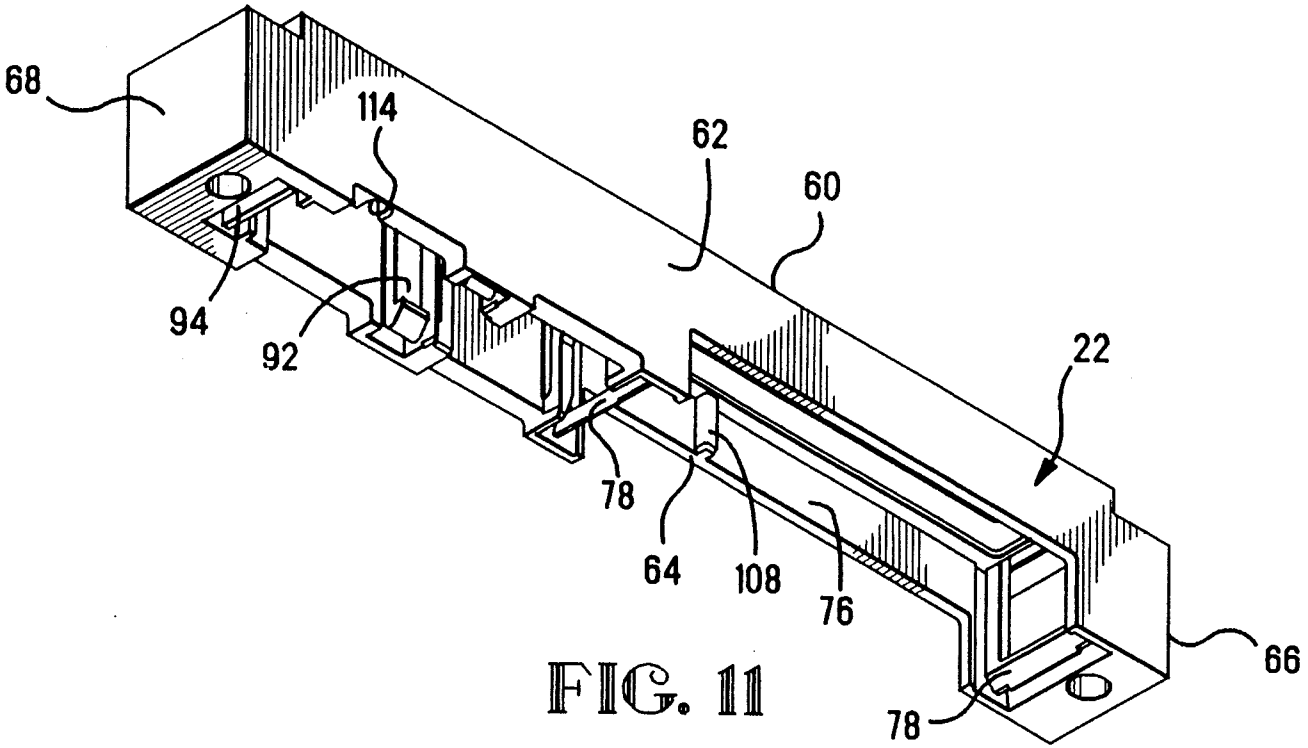
FIG. 11 is a rear perspective view of the housing of the assembly of FIG. 1.

For cooperating with the connector 24, there are two resilient latch members 78 adapted to engage the back surface 48 of the connector 24 at laterally opposed ends thereof. Each of the latch members 78 is generally planar and transverse to the upper and lower walls 62, 64 and is cantilevered from the front wall 60 rearwardly away from the front wall 60. The latch member 78 is formed with a central opening 80 which is sized to receive the enlarged portion 42 of the connector 24, with the forward facing surface 82 thereof engaging the back surface 48. As best shown in FIG. 6, each of the latch members 78 is formed at its rearmost end with a beveled camming surface 84 which cooperates with the enlarged portion 42 to move the latch member 78 transversely out of insertion path of the enlarged portion 42. During insertion of the connector 24, as the back surface 48 passes the forward facing surfaces 82, the resilient latch members 78 snap back to their relaxed positions so that the surfaces 48 and 82 are in interfering relation to prevent the inadvertent removal of the connector 24 from the cavity 76.

For cooperating with the connector 26, there are illustratively four resilient latch members 86, arranged in opposed pairs. Two of the latch members 86 are cantilevered from the upper wall 62 forwardly toward the front wall 60 and the other two of the latch members 86 are cantilevered from the lower wall 64 forwardly toward the front wall 60. Each of the latch members 86 has a forward facing surface 88 for engaging the back surface 50 of the connector 26. Further, each of the latch members 86 has a beveled camming surface 90 which cooperates with the enlarged portion 44 to move the respective latch member 86 transversely out of the insertion path of the enlarged portion 44. During insertion of the connector 26, as the back surface 50 passes the forward facing surfaces 88, the resilient latch members 86 snap back to their relaxed positions so that the surfaces 50 and 88 are in interfering relation to prevent the inadvertent removal of the connector 26 from the cavity 76.

For cooperating with the connector 28, there are provided an opposed pair of resilient latch members 92 which engage the back surface 52 at one end and a planar resilient latch member 94 for engaging the back surface 52 at the other end. Specifically, each latch member 92 is cantilevered from one of the upper and lower walls 62, 64 rearwardly away from the front wall 60 and is formed with a forward facing surface 96 for engaging the back surface 52. Each latch member 92 also has a beveled camming surface 98 which cooperates with the enlarged portion 46 to cause the latch member 92 to be moved transversely out of the insertion path of the connector 28. The latch member 94 is similar to the latch members 78 and is generally planar and transverse to the upper and lower walls 62, 64 and is cantilevered from the front wall 60 rearwardly away from the front wall 60. The latch member 94 is formed with a central opening 100 for receiving the enlarged portion 46 of the connector 28, the opening 100 having a forward facing surface 102 for engaging the back surface 52. The latch member 94 is further formed with a beveled camming surface 104 which cooperates with the enlarged portion 46 to move the latch member 94 transversely out of the insertion path of the connector 28. During insertion of the connector 28, as the back surface 52 passes the forward facing surfaces 96, 102, the resilient latch members 92, 94 snap back to their relaxed positions so that the surfaces 52 and 96, 102 are in interfering relation to prevent the inadvertent removal of the connector 28 from the cavity 76.

The housing 22 is also formed with structure for insuring that the connectors 24, 26 and 28 are properly oriented therein. This structure on the housing 22 cooperates with structure already formed on the connector bodies 36, 38, 40. Thus, the enlarged portion 42 of the connector 24 is formed with a channel 106 on one side thereof, and no channel on the other side. Thus, the housing 22, within the cavity 76, is formed with an elongated projection 108 which is complementary to the channel 106 to insure that the connector 24 can only be inserted in the housing 22 in a predetermined orientation. Similarly, the connector 26 is formed with a projection 110 on its front mating portion 32. Thus, the open region 72 on the front wall 60 is formed with a notch 112 which is complementary to the projection 110. The connector 28 is formed with an elongated projection (not shown) on its enlarged portion 46 and the housing 22 is formed with a complementary channel 114.

Thus, each of the connectors 24, 26, 28 can be inserted into the housing 22 in only a predetermined orientation. During the insertion of the connectors, the latch members are moved transversely out of the insertion path and, as the back surface of each connector passes the front surface of the corresponding latch member, the latch member snaps back to its relaxed position so that its forward facing surface engages the back surface to retain the connector within the housing, thereby forming a composite connector assembly.

Accordingly, there has been disclosed an improved composite electrical connector assembly. While a preferred embodiment of the present invention has been disclosed herein, it is understood that various modifications and adaptations to the disclosed embodiment will be apparent to those of ordinary skill in the art and it is intended that this invention be limited only by the scope of the appended claims.

We claim:

1. A composite electrical connector assembly comprising:

a plurality of cable connectors each having a contact-receiving body, each of said cable connector bodies having a front mating portion, an enlarged portion rearwardly of its front mating portion and a back surface on its enlarged portion facing away from its front mating portion; and a unitary housing for said plurality of cable connectors, said housing including:

a front wall;

upper, lower and lateral side walls extending rearwardly from said front wall to define a cavity;

said front wall having a plurality of open regions each corresponding to a respective one of said plurality of cable connector bodies, each of said plurality of open regions being sized to allow the front mating portion of the respective one of the plurality of cable connector bodies to extend therethrough and being configured to prevent the enlarged portion of the respective one of the plurality of cable connector bodies from passing therethrough;

said cavity being configured to contain therein, in laterally spaced relation, said enlarged portions of said plurality of cable connector bodies with said front mating portions of said plurality of cable connector bodies extending through the respective open regions and outwardly beyond said housing front wall; and latch means within said cavity for engaging the back surface of each of said plurality of cable connector body enlarged portions as each cable connector body is inserted in said cavity toward said front wall and its front mating portion extends through the respective open region and outwardly beyond said front wall so that the enlarged portion of said each cable connector body is held within said cavity between said front wall and said latch means, said latch means including a plurality of resilient latch members, each of which includes a forward facing surface for interfering engagement with a respective cable connector body enlarged portion back surface, each of said resilient latch members having a relaxed position in which it extends in a front to rear direction within said cavity and within the insertion path of the respective cable connector body enlarged portion and being adapted to be moved from its relaxed position transversely out of said path as said respective enlarged portion passes thereby and to subsequently return to its relaxed position with its forward facing surface in engagement with the respective enlarged portion back surface, and wherein at least one pair of said plurality of resilient latch members for one of said plurality of cable connector bodies are cantilevered and integral spaced from said upper and lower walls rearwardly away from said front wall.

2. The assembly according to claim 1 wherein each of said latch members includes a camming surface which cooperates with the respective cable connector body to move the latch member in a transverse direction during insertion of that connector within the housing cavity.

3. The assembly according to claim 1 wherein said housing and said cable connector bodies are formed with complementary structure for providing a predetermined orientation for each of said cable connector bodies within said cavity.

4. The assembly according to claim 1 wherein said housing is made of an insulative plastic and is formed by a straight pull molding process.

5. A unitary housing adapted to contain a plurality of cable connector contact-receiving bodies so as to form therewith a composite electrical .connector assembly, each of the bodies having a front mating portion, an enlarged portion rearwardly of its front mating portion and a back surface on its enlarged portion facing away from its front mating portion, said unitary housing comprising:

a front wall;

upper, lower and lateral side walls extending rearwardly from said front wall to define a cavity;

said front wall having a plurality of open regions each corresponding to a respective one of said plurality of cable connector bodies, each of said plurality of open regions being sized to allow the front mating portion of the respective one of the plurality of cable connector bodies to extend therethrough and being configured to prevent the enlarged portion of the respective one of the plurality of Cable connector bodies from passing therethrough;

said cavity being configured to contain therein, in laterally spaced relation, said enlarged portions of said plurality of cable connector bodies with said front mating portions of said plurality of cable connector bodies extending through the respective open regions and outwardly beyond said housing front wall; and latch means within said cavity for engaging the back surface of each of said plurality of cable connector body enlarged portions as each cable connector body is inserted in said cavity toward said front wall and its front mating portion extends through the respective open region and outwardly beyond said front wall so that the enlarged portion of said each cable connector body is held within said cavity between said front wall and said latch means, said latch means including a plurality of resilient latch members, each of which includes a forward facing surface for interfering engagement with a respective cable connector body enlarged portion back surface, each of said resilient latch members having a relaxed position in which it extends in a front to rear direction within said cavity and within the insertion path of the respective cable connector body enlarged portion and being adapted to be moved from its relaxed position transversely out of said path as said respective enlarged portion passes thereby and to subsequently return to its relaxed position with its forward facing surface in engagement with the respective enlarged portion back surface, and wherein at least one pair of said plurality of resilient latch members for one of said plurality of cable connector bodies are cantilevered and integral spaced from said upper and lower walls rearwardly away from said front wall.

6. The housing according to claim 5 wherein each of said latch members includes a camming surface which cooperates with the respective cable connector body to move the latch member in a transverse direction during insertion of that connector within the housing cavity.

7. The housing according to claim 5 wherein said housing and said cable connector bodies are formed with complementary structure for providing a predetermined orientation for each of said cable connector bodies within said cavity.

8. The housing according to claim 5 wherein said housing is made of an insulative plastic and is formed by a straight pull molding process.

9. A composite electrical connector assembly comprising:

a plurality of cable connectors each having a contact-receiving body, each of said cable connector bodies having a front mating portion, an enlarged portion rearwardly of its front mating portion and a back surface on its enlarged portion facing away from its front mating portion; and a unitary housing for said plurality of cable connectors, said housing including:

a front wall;

upper, lower and lateral side walls extending rearwardly from said front wall to define a cavity;

said front wall having a plurality of open regions each corresponding to a respective one of said plurality of cable connector bodies, each of said plurality of open regions being sized to allow the front mating portion of the respective one of the plurality of cable connector bodies to extend therethrough and being configured to prevent the enlarged portion of the respective one of the plurality of cable connector bodies from passing therethrough;

said cavity being configured to contain therein, in laterally spaced relation, said enlarged portions of said plurality of cable connector bodies with said front mating portions of said plurality of cable connector bodies extending through the respective open regions and outwardly beyond said housing front wall; and latch means within said cavity for engaging the back surface of each of said plurality of cable connector body enlarged portions as each cable connector body is inserted in said cavity toward said front wall and its front mating portion extends through the respective open region and outwardly beyond said front wall so that the enlarged portion of said each cable connector body is held within said cavity between said front wall and said latch means, said latch means including a plurality of resilient latch members, each of which includes a forward facing surface for interfering engagement with a respective cable connector body enlarged portion back surface, each of said resilient latch members having a relaxed position in which it extends in a front to rear direction within said cavity and within the insertion path of the respective cable connector body enlarged portion and being adapted to be moved from its relaxed position transversely out of said path as said respective enlarged portion passes thereby and to subsequently return to its relaxed position with its forward facing surface in engagement with the respective enlarged portion back surface, and wherein at least one of said plurality of resilient latch members for one of said plurality of cable connector bodies is generally planar and extends between said upper and lower walls, is cantilevered from said front wall rearwardly away from said front wall, and is formed with a central opening to receive therein the enlarged portion of said one of said plurality of cable connector bodies.

10. The assembly according to claim 9 wherein said latch members include respective camming surfaces which cooperates with respective bodies to move the latch members in respective transverse directions during insertion of said bodies within the housing cavity.

11. The assembly according to claim 9 wherein said housing and said cable connector bodies are formed with complementary structure for providing a predetermined orientation for each of said cable connector bodies within said cavity.

12. The housing according to claim 9 wherein said housing is made of an insulative plastic and is formed by a straight pull molding process.

13. A unitary housing adapted to contain a plurality of cable connector contact-receiving bodies so as to form therewith a composite electrical connector assembly, each of the bodies having a front mating portion, an enlarged portion rearwardly of its front mating portion and a back surface on its enlarged portion facing away from its front mating portion, said unitary housing comprising:

a front wall;

upper, lower and lateral side walls extending rearwardly from said front wall to define a cavity;

said front wall having a plurality of open regions each corresponding to a respective one of said plurality of cable connector bodies, each of said plurality of open regions being sized to allow the front mating portion of the respective one of the plurality of cable connector bodies to extend therethrough and being configured to prevent the enlarged portion of the respective one of the plurality of cable connector bodies from passing therethrough;

said cavity being configured to contain therein, in laterally spaced relation, said enlarged portions of said plurality of cable connector bodies with said front mating portions of said plurality of cable connector bodies extending through the respective open regions and outwardly beyond said housing front wall; and latch means within said cavity for engaging the back surface of each of said plurality of cable connector body enlarged portions as each cable connector body is inserted in said cavity toward said front wall and its front mating portion extends through the respective open region and outwardly beyond said front wall so that the enlarged portion of said each cable connector body is held within said cavity between said front wall and said latch means, said latch means including a plurality of resilient latch members, each of which includes a forward facing surface for interfering engagement with a respective cable connector body enlarged portion back surface, each of said resilient latch members having a relaxed position in which it extends in a front to rear direction within said cavity and within the insertion path of the respective cable connector body enlarged portion and being adapted to be moved from its relaxed position transversely out of said path as said respective enlarged portion passes thereby and to subsequently return to its relaxed position with its forward facing surface in engagement with the respective enlarged portion back surface, and wherein at least one of said plurality of resilient latch members for one of said plurality of cable connector bodies is generally planar and extends between said upper and lower walls, is cantilevered from said front wall rearwardly away from said front wall, and is formed with a central opening to receive therein the enlarged portion of said one of said plurality of cable connector bodies.

14. The housing according to claim 13 wherein said latch members include respective camming surfaces which cooperates with respective bodies to move the latch members in respective transverse directions during insertion of the bodies within the housing cavity.

15. The housing according to claim 13 wherein said housing and said bodies are formed with complementary structure for providing a predetermined orientation for each of said cable connector bodies within said cavity.

16. The housing according to claim 13 wherein said housing is made of an insulative plastic and is formed by a straight pull molding process.

* * * * *